US008827131B2

(12) United States Patent
Zahner et al.

(10) Patent No.: US 8,827,131 B2
(45) Date of Patent: Sep. 9, 2014

(54) SWITCHING ADAPTER FOR INDIVIDUAL SETTINGS WITH HAND-HELD SETTING TOOL

(75) Inventors: Mario Zahner, Chur (CH); Rolf Erhardt, Buchs (CH)

(73) Assignee: Hilt Aktiengesellschaft, Schaan (LI)

( * ) Notice: Subject to any disclaimer, the term of this patent is extended or adjusted under 35 U.S.C. 154(b) by 93 days.

(21) Appl. No.: 12/381,634

(22) Filed: Mar. 12, 2009

(65) Prior Publication Data

US 2010/0140313 A1 Jun. 10, 2010

(30) Foreign Application Priority Data

Dec. 10, 2008 (DE) ..... 10 2008 054 483

(51) Int. Cl.
*B25C 1/00* (2006.01)

(52) U.S. Cl.
USPC ..... 227/8; 227/120

(58) Field of Classification Search
USPC ..... 227/8, 120, 125
See application file for complete search history.

(56) References Cited

U.S. PATENT DOCUMENTS 5,020,712 A * 6/1991 Monacelli ..... 227/8
5,167,359 A * 12/1992 Frommelt ..... 227/8
5,441,191 A * 8/1995 Linden ..... 227/120
5,511,715 A * 4/1996 Crutcher et al. ..... 227/131
5,597,972 A * 1/1997 Wachter ..... 89/1.14
5,996,874 A * 12/1999 Fukushima et al. ..... 227/8
6,056,181 A * 5/2000 Chuang ..... 227/8
6,267,284 B1 * 7/2001 Clark ..... 227/8
6,708,860 B1 * 3/2004 Thieleke ..... 227/8
6,783,043 B2 * 8/2004 Jakob et al. ..... 227/8
6,971,568 B2 * 12/2005 Schiestl et al. ..... 227/8
7,059,507 B2 * 6/2006 Almeras et al. ..... 227/8
7,182,236 B1 * 2/2007 Wen ..... 227/8
7,331,403 B2 * 2/2008 Berry et al. ..... 173/1
2005/0218185 A1 * 10/2005 Kenney et al. ..... 227/133
2006/0091176 A1 * 5/2006 Cannaliato et al. ..... 227/8
2008/0067213 A1 * 3/2008 Shima et al. ..... 227/129

* cited by examiner

*Primary Examiner* — Brian D Nash

(74) *Attorney, Agent, or Firm* — Abelman, Frayne & Schwab

(57) ABSTRACT

A switching adapter for enabling individual settings with a hand-held setting tool (10) having a magazine (40) for fastening elements (51), and a detection element (31) for detecting presence of a fastening element (51) in a receiving chamber of the setting tool. The adapter (60) includes a retaining section (61) for releasably mounting the switching adapter (60) on the fastening elements magazine (40) of the setting tool (10), and an actuation section (62) that displaces the detection element (31) of the setting tool from its a locking position to its release position.

4 Claims, 4 Drawing Sheets

SWITCHING ADAPTER FOR INDIVIDUAL SETTINGS WITH HAND-HELD SETTING TOOL

BACKGROUND OF THE INVENTION

1. Field of the Invention

The present invention relates to a switching adapter for enabling individual settings with a hand-held setting tool having a magazine for fastening elements and a detection element for detecting presence of a fastening element in a receiving chamber of the setting tool.

2. Description of the Prior Art

U.S. Patent Publication US 2005/0017046 discloses a setting tool for driving in fastening elements and including a fastening element guide displaceable in the muzzle part of the setting tool, and a magazine for fastening elements which projects sidewise from the muzzle part. In the muzzle part, there is provided a receiving chamber for a to-be-set fastening element and which is open toward a guide channel of the fastening element magazine. On the muzzle part, further, there is mounted a detection element for fastening elements arranged on a magazine strip. The detection element detects presence in the receiving chamber of a fastening element stored on the magazine strip. If no fastening element is located in the receiving chamber, the detection element occupies a safety position in which displacement of the fastening element guide in the muzzle part is prevented. A setting process in the safety position of the detection element is not possible.

The drawback of the setting tool disclosed in the above-mention U.S. patent publication consists in that the setting tool cannot operate with individual fastening elements which are not fed to the muzzle part by the transporting slide of the magazine.

Accordingly, an object of the present invention is to enable use of a hand-held setting tool having a fastening element magazine with fastening elements not stored in the fastening element magazine.

SUMMARY OF THE INVENTION

This and other objects of the present invention, which will become apparent hereinafter, by providing a switching adapter having a retaining section for releasably mounting the switching adapter on the magazine and an actuation section for displacing the defection element from its locking position to its release position. With the inventive switching adapter, setting of fastening elements, which are not stored in the fastening element magazine of the setting tool, became possible.

Advantageously, the retaining section is formed for being mounted on a side wall of the fastening element magazine. This insures an easy mounting and dismounting of the switching adapter.

It is further advantageous when the holding section of the switching adapter is formed as a fork-shaped element having at least two opposite prongs. With this construction, the switching adapter can be pinned on the side wall as a clip.

According to a constructively simple embodiment of the inventive switching adapter, the adapter includes an actuation section for cooperating with the detection element and arranged on a bridge section that connects the at least two opposite prongs.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 2:
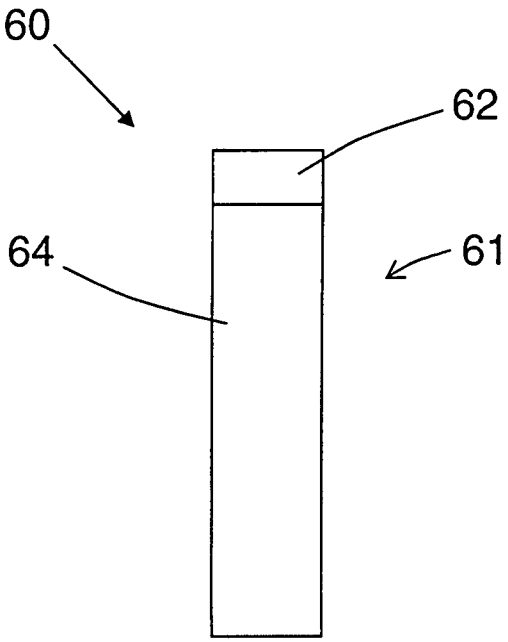
FIG. 2 a view of the adapter shown in FIG. 1 in direction II in FIG. 1.
Figure 1:
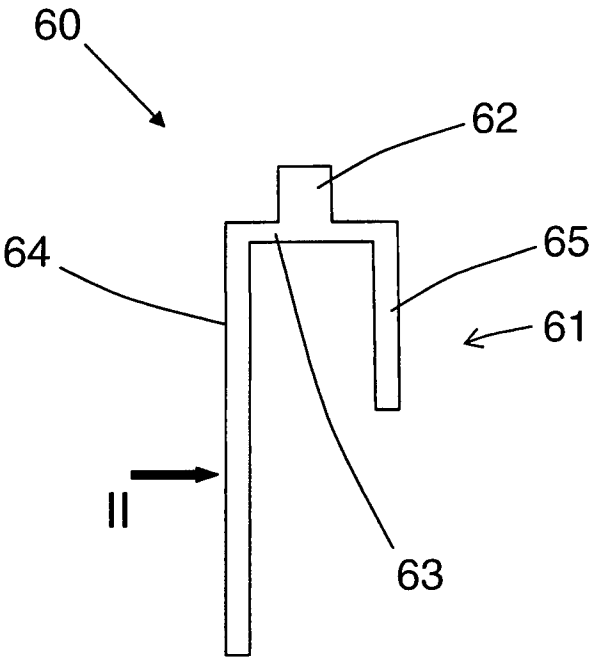
FIG. 1 a side view of a switching adapter according to present invention.

FIGS. 1 and 2 show a switching adapter 60 according to the present invention which enables carrying out of single settings with a hand-held setting tool 10 that includes a magazine 40 for fastening elements (see FIGS. 3 through 6). The switching adapter 60 has a fork-shape retaining section 61 for reversibly mounting the switching adapter on a side wall 44 of the fastening element magazine 40, and an actuation section 62 that cooperates with a detection element 31 of the setting tool 10. The fork-shaped retaining section 61 has two opposite prongs 64, 65.

The second prong 65 is shorter than the first prong 64. The first and second prongs 64, 65 are connected with each other by a bridge section 63 that carries, on its side remote from the prongs 64, 65, the actuation section 62. The detection element 31 serves for detecting presence of a fasting element 51 in a receiving chamber 23 of the setting tool 10. The switching adapter 60 is capable of displacing the detection element 31 into its release position in which a setting process is possible even when no fastening element 51, which previously was stored in the magazine 40 for fastening elements, is located in the receiving chamber 23, as it will be described in more detail further below.

FIGS. 3 through 6 show, as it has already been mentioned above, the setting tool 10 in which the inventive switching adapter 60 is used. The setting tool 10 has a setting mechanism, not shown in the drawings, which is located in one- or multi-part housing 11. The setting mechanism includes a setting piston displaceable in a guide cylinder 14 for driving fastening elements 51 in a constructional component K. The setting tool 10 has further a handle 12 on which an actuation switch 13 for initiating a setting process is arranged.

In the setting tool 10, in front of the housing 11, there is provided a muzzle part generally designated with a reference numeral 20. The muzzle part 20 adjoins the guide cylinder 14 at one of its ends (see in particular FIGS. 3-4). The muzzle part 20 includes a base body 21 relative to which a fastening element guide 15 is displaceable. The fastening element guide 15 is supported by a spring (not visible in the drawings), against the base body 21 or against another component that is fixed relative to the housing 11. The spring biases the fastening element guide 15 in the direction of its non-press-on position shown in FIG. 3. When the setting tool 10 is pressed against the constructional component K as shown in FIG. 4, the fastening element guide 15 is displaced in the direction of guide cylinder 14, tensioning the spring. A press-on member 16, which is fixedly connected with the fastening element guide 15, is displaced together with the fastening element guide 15. The displacement of the press-on member 16 transfer the setting tool 10 into its setting ready position that can be activated by the actuation switch 13. The valve for feeding fuel into combustion chamber of the setting tool 10 can be actuated by the press-on-member 16 and by an adjusting member located downstream on the press-on member 16.

In the muzzle part 20, there is provided a receiving chamber 23 that extends in the longitudinal direction L of the fastening element guide 15. Only a fastening element 51, which is properly positioned in the receiving chamber 23, can be engaged by the setting piston and driven in the constructional component K. The fastening element 51 is fed to the receiving chamber 23 from a fastening element magazine 40 preferably replaceably mountable on the muzzle part 20. The fastening element magazine 40 is secured on the base body 21 of the muzzle part 20 by a connection section 42. The fastening elements 51 are displaceable in the fastening element magazine 40 in a guide chamber 43 provided therein. The fastening elements 51 are, e.g., assembled in a fastening element strip 50 which is insertable into the guide chamber 43. The fastening elements 51 are supported on a support member formed of a plurality of support segments 52.

In the fastening element magazine 40, the is arranged a transporting member 41 (see FIGS. 3, 4, and 6) that is biased in its operational position toward the receiving chamber 23 by a spring, not shown, and that insures feeding of the fastening elements 51 to the receiving chamber 23. The detection elements 31 for detecting presence of a fastening element 51 in the receiving chamber 23 is also arranged on the muzzle part 20. The detection element 31 insures than the setting process can only then be actuated when a fastening element 51, which was stored on the fastening element strip 50, is located in the receiving chamber 23, and the setting tool 10 is pressed against the constructional component K. To this end, the detection element 31 is located on the side of the chamber 23 opposite the fastening element magazine 40, with the detection element 31 surrounding the receiving chamber 23 at least in one region. The detection element 31 is formed as a lever pivotally supported on a pivot element 38 provided on the base body 21 of the muzzle part 20 for pivotal movement parallel to the longitudinal direction L (see in particular FIGS. 5-6).

The first arm of the detection element 31 is formed as a detection section 33 for the fastening element 51, and a second arm forms a projection 32 with a counter-stop 37 for a stop 17 provided on the press-on member 16. The detection section 33 has, on its side adjacent to the receiving chamber 23, two concave guide surfaces 35, 36 extending parallel to the longitudinal direction L and formed as half-shell-shaped tubular segments. The guide surfaces 35, 36 extend laterally adjacent to a groove-shaped guide surface 34 extending parallel to the longitudinal direction 34. The inner profile of the detection section 33, which is formed by a first guide surface 34 and both concave second and third surfaces 35, 36, can be optimally adapted to the outer profile of the support segment 52 of the fastening element strip 53 to insure a good guidance and positioning of the strip 50.

A spring, not visible in the drawings, biases the detection element 31 in the direction of its locking position in which the detection element 31 narrows the guide chamber 18 in the base body 21 when no fastening element 51 is located therein. The detection element 31 prevents, in this position (see FIG. 6), a relative movement between the fastening element guide 15 and the base body 21. In this position of the detection element 31, the stop 17 of the press-on chamber 16 is located opposite the counter-stop 37, which is provided on the detection element 31, and engages the counter-stop 37 upon an attempt to press the setting tool 10 against the constructional component. Thus a press-on step and a subsequent setting process are prevented in the locking position of the detection element 31.

Figure 3:
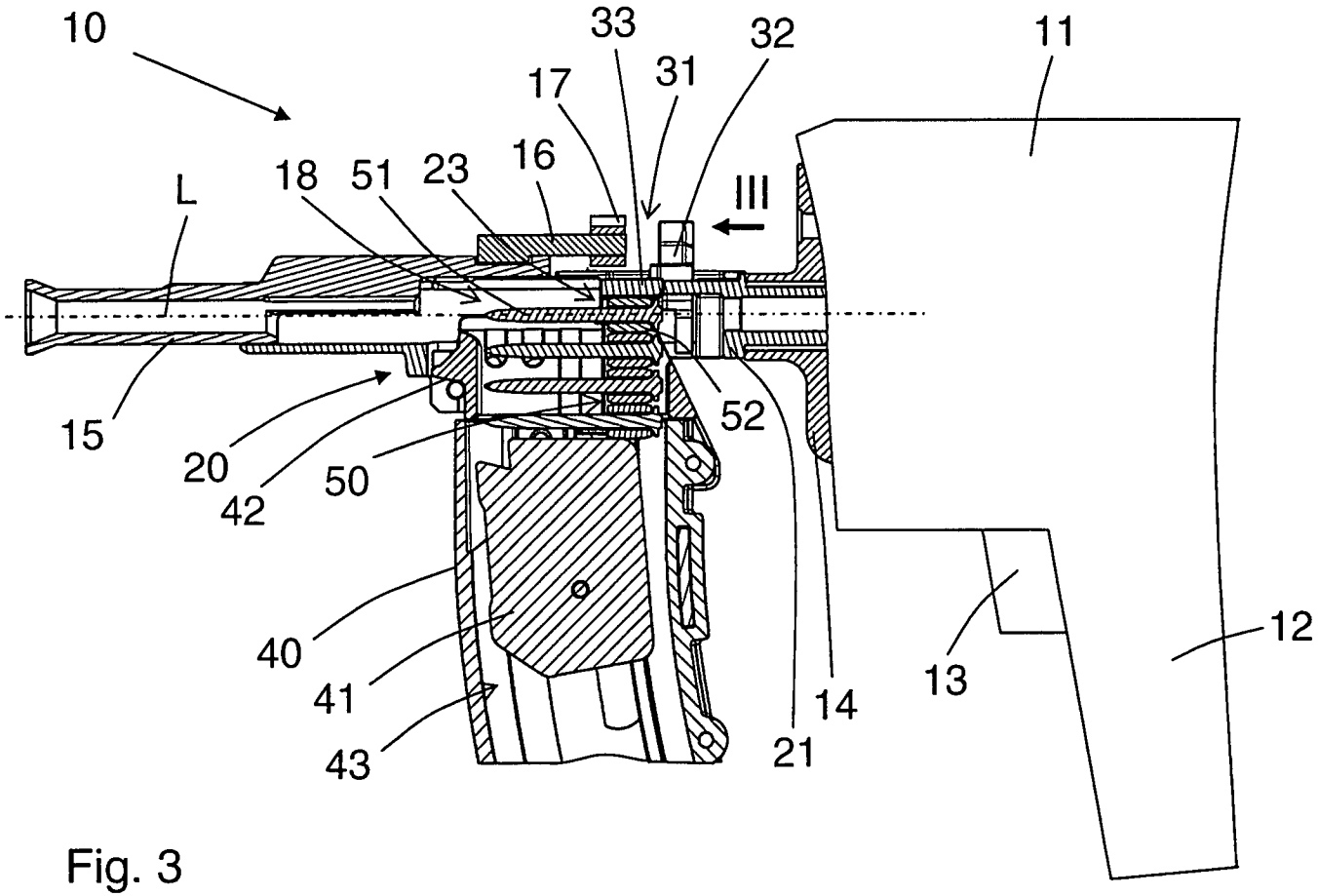
FIG. 3 a partially cross-sectional view of a setting tool and its muzzle part in a non-pressed-on position.
Figure 4:
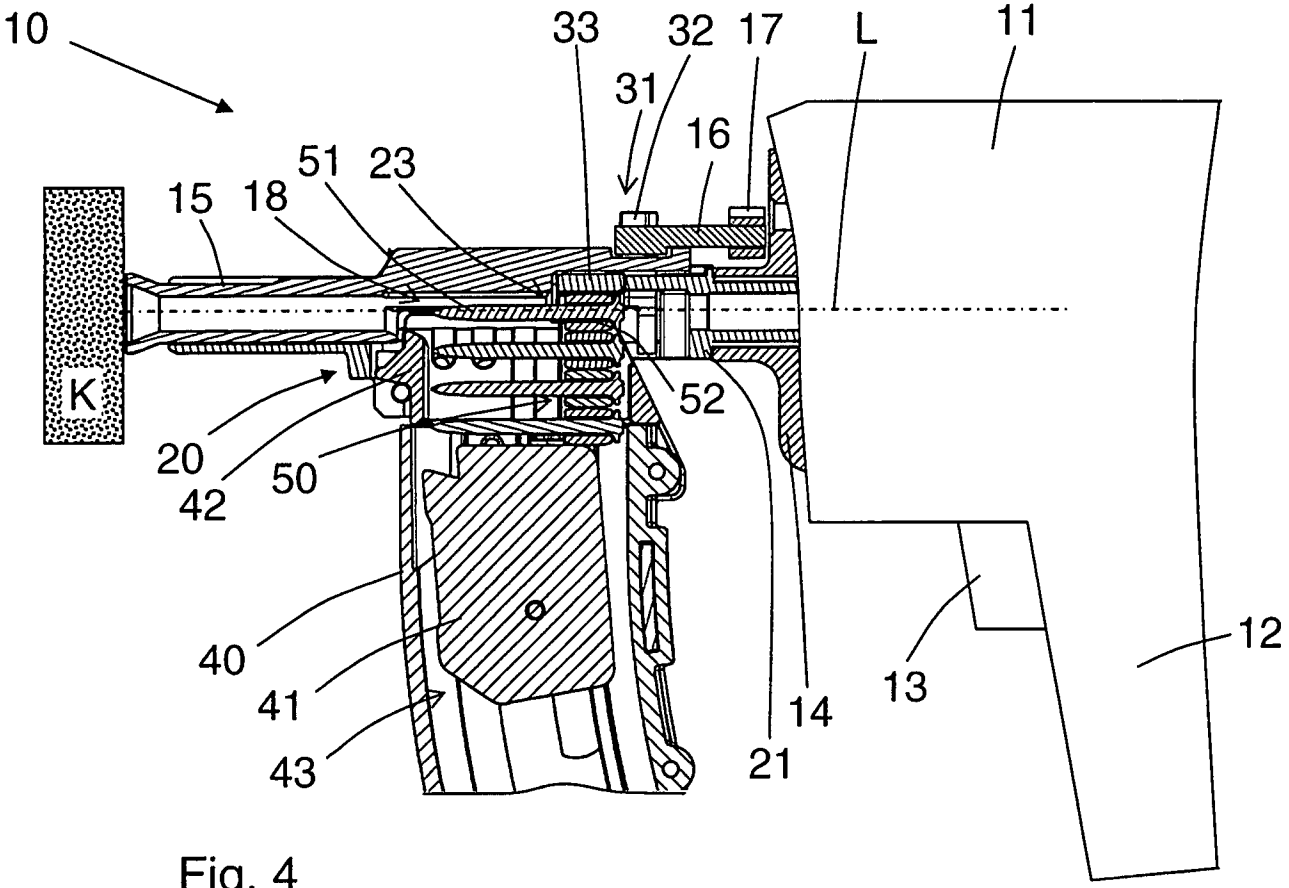
FIG. 4 a partially cross-sectional view of the setting tool shown in FIG. 3, together with a magazine for fastening element in a press-on position.
Figure 6:
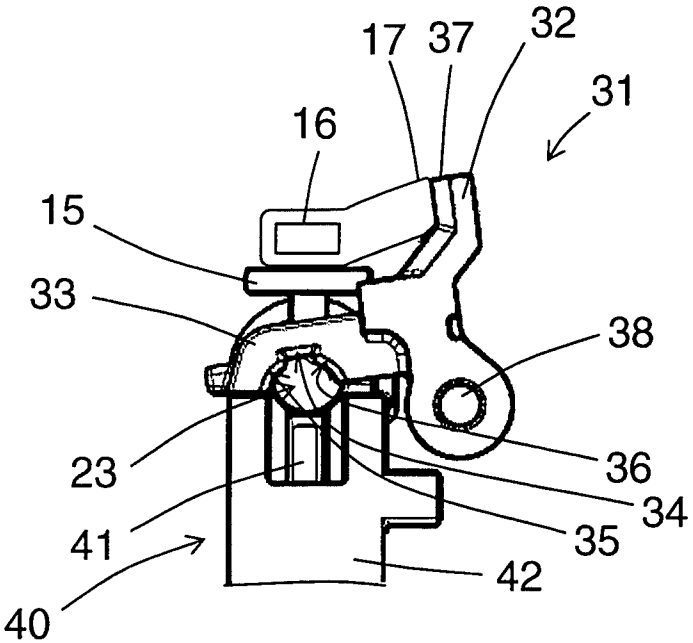
FIG. 6 a view of a detail of the muzzle part of the setting tool shown in FIG. 3 in direction of arrow III with an empty receiving chamber but without a switching adapter.

FIG. 3 shows the setting tool in a position in which the setting tool 10 is not yet pressed with its muzzle part 20 against a constructional component. Several fastening elements 51 of the fastening strip 50 are located in the guide channel 43 of the fastening element magazine 40 and, in particular, a fastening element 51 is located in the receiving chamber 23 of the muzzle part 23. The detection element 31 is displaced by the fastening elements 51 in its release position (also see FIG. 40) because the biasing force, which act on the transportation element 41 in the direction of the receiving chamber 23 is greater than the biasing force acting on the detection element 31 in the direction of the locking position of the detection element 31. In the release position of the detection element 31, pressing the setting tool 10 against the constructional component and a subsequent setting process are possible, as it can be seen from FIG. 4. During the press-on process, the fastening element guide 15 is displaced toward the housing 11 and relative to the base body 21. With the fastening guide element 15 being formlockingly guided and with the fastening element 51, which is located in the receiving chamber 23 of the muzzle part 20, being supported by its support segment 52 engaging the guide surfaces 34, 35, 36 of the detection section 33 of the detection element 31, tilting of the fastening element 51 during the press-on process is reliably prevented. Thus, the setting tool 10 is ready for initiating a setting process.

Figure 5:
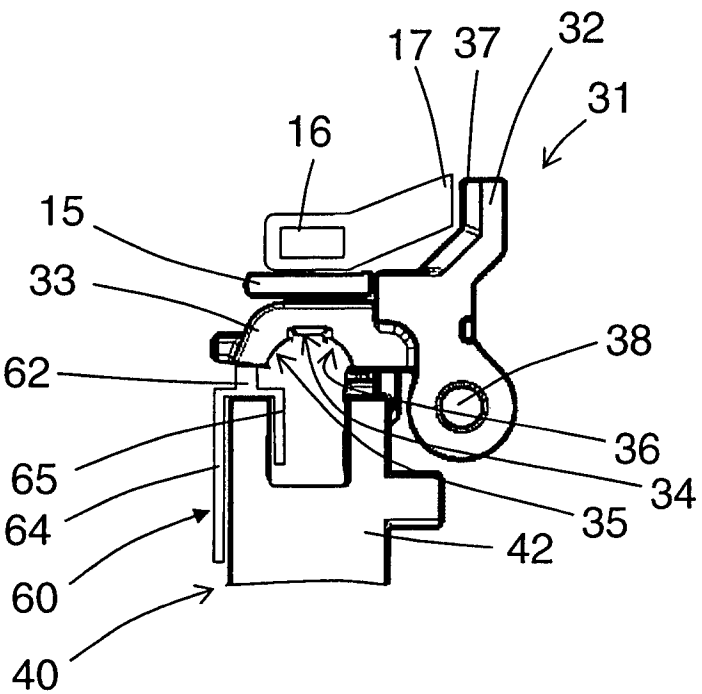
FIG. 5 a view of a detail of the muzzle part of the setting tool shown in FIG. 3 in direction of arrow III with an empty receiving chamber and with a switching adapter.

When a single fastening element, which is not located in the magazine 40, need be set, then, the detection element 31 need be displaced in its release position by the switching adapter 60, as shown in FIG. 5. To this end, the switching adapted 60 is pinned on the side wall 44 of the fastening element magazine 40, with its retaining section 61 which surrounds the side wall 44 with both of its legs 64, 65. The switching adapter 60 is so positioned on the side wall 44 that its actuation section 61 engages the outer edge of the detection section 33 of the detection element 31 and, thereby, retains the detection element 31 in its release position in which the setting tool 10 is ready for start of the setting process.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held setting tool (10), comprising a magazine (40) for fastening elements (51); a detection element (31) for detecting presence of a fastening element (51) in a receiving chamber (23) of the setting tool (10); and a switching adapter (60) for enabling individual settings of the setting tool (10)

and having a retaining section (61) for releasably mounting the switching adapter (60) on the magazine (40); and an actuation section (62) for displacing the detection element (31) from a locking position thereof to a release position thereof and formed integrally with the retaining section (61), wherein the detection element (31) has a detection section (33) displaceable into the receiving chamber (23) in the absence of the fastening element (51) therein, and wherein the actuation section (62) of the adapter (60) pushes the detection section (33) out of the receiving chamber (23) in a mounted condition of the adapter (60) for enabling individual settings.

2. A switching adapter according to claim 1, wherein the retaining section (61) is formed as a fork-shaped element having at least two opposite prongs (64, 65).

3. A switching adapter according to claim 2, wherein the actuation section (62) is arranged on a bridge section (63) that connects the at least two opposite prongs (64, 65).

4. A hand-held setting tool according to claim 1, wherein the retaining section (61) is mountable on a side wall (44) of the fastening element magazine (40).

* * * * *